US011717878B2

(12) United States Patent
Kang et al.

(10) Patent No.: US 11,717,878 B2
(45) Date of Patent: Aug. 8, 2023

(54) DEVICE FOR FASTENING LOCKBOLT

(71) Applicant: Tae Sun Kang, Ulsan (KR)

(72) Inventors: Tae Sun Kang, Ulsan (KR); GeunHo Nam, Ulsan (KR)

(73) Assignee: Tae Sun Kang, Ulsan (KR)

( * ) Notice: Subject to any disclaimer, the term of this patent is extended or adjusted under 35 U.S.C. 154(b) by 237 days.

(21) Appl. No.: 17/430,656

(22) PCT Filed: Nov. 24, 2019

(86) PCT No.: PCT/KR2019/016207
§ 371 (c)(1),
(2) Date: Aug. 12, 2021

(87) PCT Pub. No.: WO2020/166795
PCT Pub. Date: Aug. 20, 2020

(65) Prior Publication Data

US 2022/0118504 A1 Apr. 21, 2022

(30) Foreign Application Priority Data

Feb. 12, 2019 (KR) ..... 10-2019-0015905

(51) Int. Cl.
*B21J 15/22* (2006.01)
*B21J 15/28* (2006.01)

(52) U.S. Cl.
CPC ..... *B21J 15/22* (2013.01); *B21J 15/28* (2013.01)

(58) Field of Classification Search
CPC ..... B21J 15/22; B21J 15/28; B21J 15/20
(Continued)

(56) References Cited

U.S. PATENT DOCUMENTS 3,996,784 A * 12/1976 Champoux ..... B21J 15/022 29/520
4,852,376 A 8/1989 Suhov
(Continued)

FOREIGN PATENT DOCUMENTS

KR 10-1515974 B1 5/2015
KR 10-1831557 B1 4/2018

*Primary Examiner* — Robert F Long
*Assistant Examiner* — Xavier A Madison
(74) *Attorney, Agent, or Firm* — Maschoff Brennan

(57) ABSTRACT

The present disclosure relates to a device for fastening a lockbolt, the device comprising: a lockbolt gun including a body unit having a grip therein for pulling the lockbolt and a gripping unit protruding from a lower portion of the body unit and having an operation switch installed on the outside, wherein a hydraulic supply flow path for supplying hydraulic pressure for driving the grip, a hydraulic discharge flow path for discharging hydraulic pressure supplied to the grip, and an air supply flow path for supplying pneumatic pressure to the operation switch are installed in the gripping unit, and a discharge hole is formed outside the gripping unit to discharge air from the air supply flow path when the operation switch is operated; a driving force supply unit having a hydraulic supply pump that supplies hydraulic pressure to the hydraulic supply flow path, a hydraulic recovery pump that recovers hydraulic pressure discharged from the hydraulic discharge flow path, and an oil tank that supplies oil to the hydraulic supply pump and recovers oil from the hydraulic recovery pump; an operating unit having a first solenoid valve connected to the hydraulic supply pump, the hydraulic recovery pump, and the air supply flow path, an air supply unit that supplies air to the first solenoid valve, and an air pressure regulator installed between the first solenoid valve and the air supply unit to regulate pneumatic pressure supplied to the first solenoid valve; a housing accommodating the driving force supply unit and
(Continued)

the operating unit; and a control unit for controlling the hydraulic supply pump and the hydraulic recovery pump to operate so that the pneumatic pressure is supplied from the first solenoid valve to the hydraulic supply pump and the hydraulic recovery pump when an operating signal is inputted from the operation switch.

6 Claims, 2 Drawing Sheets

(58) Field of Classification Search
USPC ..... 29/469.5
See application file for complete search history.

(56) References Cited

U.S. PATENT DOCUMENTS

| | | | | |
|---|---|---|---|---|
| 5,647,209 | A | 7/1997 | Wilcox | |
| 6,516,510 | B1 * | 2/2003 | Fulbright | B21J 15/28 29/709 |
| 2003/0000063 | A1 * | 1/2003 | Tsegga | F16B 19/05 29/252 |

* cited by examiner

DEVICE FOR FASTENING LOCKBOLT

TECHNICAL FIELD

The present invention relates to a lockbolt fastening device for detecting abnormal operation when objects are interconnected using a lockbolt.

BACKGROUND ART

In general, parts of a vehicle are fastened through welding and a fastening member. As the fastening member, a bolt, a nut, a rivet, a lockbolt, etc. are used.

Most parts of a vehicle are fastened using bolts and nuts, but the parts fastened with bolts and nuts have a problem in that the bolts or nuts are separated due to vibration generated while the vehicle travels.

To address this issue, recently, a lockbolt has been used to semi-permanently combine parts of a vehicle.

According to bolting using a lockbolt, a lockbolt pin is inserted into a coupling hole formed in an object, a lockbolt collar is coupled to the lockbolt pin at an opposite side, and then a tool is operated to compress the collar, and accordingly, the collar is strongly pressed into a groove form in the pin to couple the objects to each other. In this case, a part of the pin is cut.

However, the aforementioned fastening using a lockbolt has the following problems.

First, if lock bolting is not performed correctly due to a defect in the material itself, or if the lockbolt material is not fastened to the object with a specified pressure, when an operator recognizes only a lock bolting condition with the naked eye and completes the work, there is a problem in that a product in a poor lock bolting condition is considered a good product.

Second, even if an operator fastens an object in the state in which the lockbolt collar is omitted, there is no method of checking the omission, and there is a problem in that inspection needs to be further performed in order to prevent this, thereby degrading workability and productivity.

DISCLOSURE

Technical Problem

Therefore, the present disclosure has been made in view of the above problems, and it is one object of the present disclosure to provide a lockbolt fastening device for detecting abnormal fastening of a lockbolt to an object when the object is fastened using the lockbolt, and fastening the lockbolt to an accurate position.

Technical Solution

In accordance with one aspect of the present disclosure, provided is a lockbolt fastening device including a lockbolt gun including a body portion provided with a grip for pulling a lockbolt therein, and a grip portion protruding from a lower portion of the body portion and having an operation switch installed on an outside, wherein a hydraulic pressure supply passage configured to supply hydraulic pressure for driving the grip, a hydraulic pressure discharge passage configured to discharge hydraulic pressure supplied to the grip, and an air supply passage configured to supply pneumatic pressure to the operation switch are installed inside the grip portion, and a discharge hole configured to discharge air of the air supply passage when the operation switch is operated is formed outside the grip portion, a driving force supply unit including a hydraulic pressure supply pump configured to supply hydraulic pressure to the hydraulic pressure supply passage, a hydraulic recovery pump configured to recover hydraulic pressure discharged from the hydraulic pressure discharge passage, and an oil tank configured to supply oil to the hydraulic pressure supply pump and to recover oil from the hydraulic recovery pump, an operation unit including a first sol valve connected to the hydraulic pressure supply pump, the hydraulic recovery pump, and the air supply passage, an air supply unit configured to supply air to the first sol valve, and an air pressure regulator installed between the first sol valve and the air supply unit and configured to adjust pneumatic pressure supplied to the first sol valve, a housing configured to accommodate the driving force supply unit and the operation unit, and a controller configured to, upon receiving an operation signal from the operation switch, perform control to supply the pneumatic pressure from the first sol valve to the hydraulic pressure supply pump and the hydraulic recovery pump and to operate the hydraulic pressure supply pump and the hydraulic recovery pump.

The lockbolt fastening device may further include an air pressure sensor configured to detect pneumatic pressure supplied from the air supply unit, wherein the controller may control the air pressure regulator to operate when the pneumatic pressure supplied from the air supply unit is outside a preset value.

The lockbolt fastening device may further include a first hydraulic pressure sensor configured to detect hydraulic pressure supplied to the hydraulic pressure supply passage, and a second hydraulic pressure sensor configured to detect hydraulic pressure discharged from the hydraulic pressure discharge passage, wherein the controller may perform control to operate the air pressure regulator when the supplied hydraulic pressure and the discharged hydraulic pressure are outside a preset value.

A second sol valve may be installed between the first sol valve and the air supply passage, and the controller may perform control to block air supply to the air supply passage from the first sol valve based on the operation signal of the operation switch and to discharge air present in the air supply passage through an air discharge port included in the second sol valve.

A third sol valve may be installed between the first sol valve and the air supply unit, and the controller may perform control to operate the third sol valve and to supply the air to the first sol valve when the lockbolt gun is located in a pre-input working position.

The lockbolt fastening device may further include a temperature sensor configured to detect temperature inside the housing, wherein the controller may continuously control the air pressure regulator according to a preset algorithm to correct the hydraulic pressure detected by the first hydraulic pressure sensor to a preset value in conjunction with the temperature detected by the temperature sensor.

Advantageous Effects

According to embodiments having the aforementioned configuration, abnormal coupling of a lockbolt to an object may be detected when the object is coupled using the lockbolt, and the lockbolt may be coupled at an accurate position, thereby improving productivity and quality.

DESCRIPTION OF REFERENCE NUMERALS OF MAIN COMPONENTS

Figure 1:
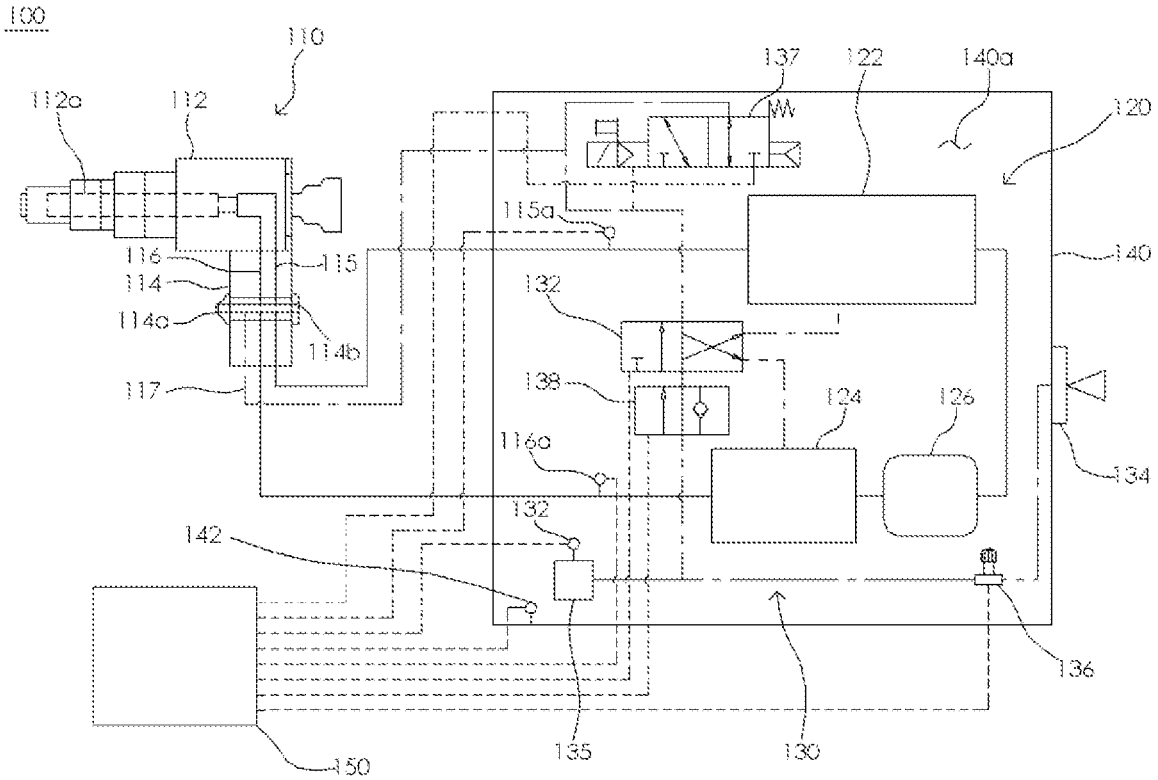
FIG. 1 is a schematic diagram showing the configuration of a lockbolt fastening device according to an embodiment of the present disclosure.

110; lockbolt gun
120; driving force supply unit
122; hydraulic pressure supply pump
124; hydraulic recovery pump
126; oil tank
130; operation unit
140; housing
150; controller

BEST MODE

An embodiment of the present disclosure will be described in more detail with reference to the accompanying drawings. In this process, the thicknesses of the lines or the sizes of the components shown in the drawings may be exaggerated for clarity and convenience of explanation.

Terms to be described later are defined in consideration of functions in the present disclosure, which may vary according to intentions or customs of users and operators. Therefore, these terms need to be defined based on the content throughout this specification.

Figure 2:
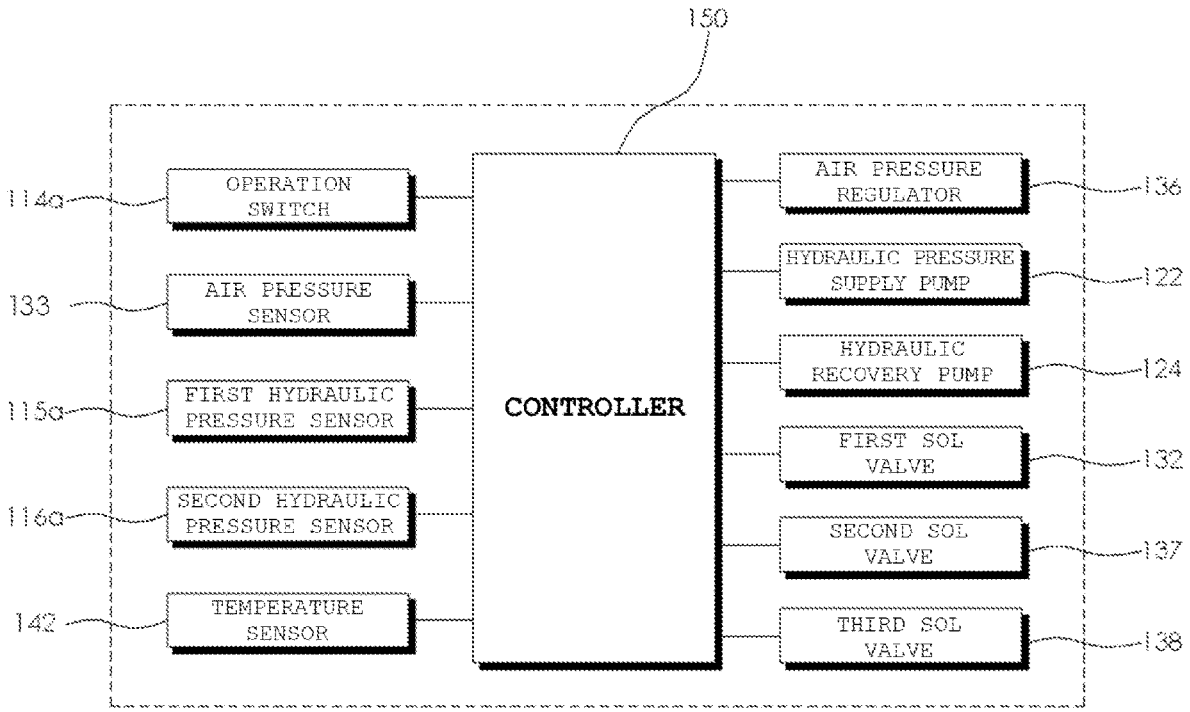
FIG. 2 is a functional block diagram of the configuration related to control of a lockbolt fastening device according to an embodiment of the present disclosure.

FIG. 1 is a schematic diagram showing the configuration of a lockbolt fastening device according to an embodiment of the present disclosure. FIG. 2 is a functional block diagram of the configuration related to control of a lockbolt fastening device according to an embodiment of the present disclosure.

Referring to the drawings, a lockbolt fastening device 100 according to an embodiment may include a lockbolt gun 110, a driving force supply unit 120, an operation unit 130, a housing 140, and a controller 150.

The lockbolt gun 110 may include a body portion 112 provided with a grip 112*a* for pulling the lockbolt therein, and a grip portion 114 protruding from a lower portion of the body portion 112 and having an operation switch 114*a* installed on the outside.

Here, inside the grip portion 114, a hydraulic pressure supply passage 115 for supplying hydraulic pressure for driving the grip 112*a*, a hydraulic pressure discharge passage 116 for discharging the hydraulic pressure supplied to the grip 112*a*, and an air supply passage 117 for supplying pneumatic pressure to the operation switch 114*a* may be installed.

A discharge hole 114*b* for discharging air of the air supply passage 115 when the operation switch 114*a* is operated may be formed outside the grip portion 114.

The driving force supply unit 120 may supply hydraulic pressure for operation of the grip 112*a* to the grip 112*a* and may include a hydraulic pressure supply pump 122 for supplying hydraulic pressure to the hydraulic pressure supply passage 115, a hydraulic recovery pump 124 for recovering hydraulic pressure discharged from the hydraulic pressure discharge passage 116, and an oil tank 126 for supplying oil to the hydraulic pressure supply pump 122 and recovering oil from the hydraulic recovery pump 124.

Here, a first hydraulic pressure sensor 115*a* for detecting the hydraulic pressure supplied from the hydraulic pressure supply pump 122 may be installed in the hydraulic pressure supply passage 115, and a second hydraulic pressure sensor 116*a* for detecting the hydraulic pressure that is discharged from the hydraulic pressure discharge passage 116 and recovered by the hydraulic recovery pump 124 may be installed in the hydraulic pressure discharge passage 116.

The operation unit 130 may be controlled by the controller 150 to be described later based on an operation signal of the operation switch 114*a* to supply pneumatic pressure for operation of the driving force supply unit 120 to the driving force supply unit 120 and may include a first sol valve 132 connected to the hydraulic pressure supply pump 122, the hydraulic recovery pump 124, and the air supply passage 117, an air supply unit 134 for supplying air to the first sol valve 132, and an air pressure regulator 136 installed between the first sol valve 132 and the air supply unit 134 and configured to adjust pneumatic pressure supplied to the first sol valve 132.

Here, an air pressure sensor 133 for detecting the pneumatic pressure supplied to the first sol valve 132 from the air supply unit may be installed between the air supply unit 134 and the first sol valve 132. A gauge 135 for allowing an operator to check the pressure of air supplied to the first sol valve 132 may be installed in the air pressure sensor 133.

A second sol valve 137 for controlling a restart time of the operation switch 114*a* may be installed between the first sol valve 132 and the air supply passage 117, and a third sol valve 138 may be installed between the first sol valve 132 and the air supply unit 134.

The housing 140 may have a housing shape having a space portion 140*a* therein, and the space portion 140*a* inside the housing 140 may accommodate the aforementioned driving force supply unit 120 and operation unit 130.

A temperature sensor 142 for detecting the temperature of the space portion 140*a* may be installed at a predetermined position inside the housing 140.

The controller 150 may perform control to supply the pneumatic pressure from the first sol valve 132 to the hydraulic pressure supply pump 122 and the hydraulic recovery pump 124 to operate the hydraulic pressure supply pump 122 and the hydraulic recovery pump 124 based on the operation signal of the operation switch 114*a*.

The controller 150 may control the aforementioned air pressure regulator 136, the second sol valve 137, and the third sol valve 138 as well as the first sol valve 132. In this case, the controller 150 may receive information from the operation switch 114*a*, the first hydraulic pressure sensor 115*a*, the second hydraulic pressure sensor 116*a*, the air pressure sensor 133, and the temperature sensor 142.

The controller 150 may control the air pressure regulator 136 to supply the pneumatic pressure supplied to the first sol valve 132 as a preset value when the pneumatic pressure supplied to the first sol valve 132 from the air supply unit 134 is outside the preset value.

The controller 150 may control the air pressure regulator 136 to adjust the pneumatic pressure supplied to the first sol valve 132 in such a way that the hydraulic pressure supplied to the hydraulic pressure supply passage 115 and the hydraulic pressure discharged from the hydraulic pressure discharge passage 116 become a preset value when the hydraulic pressure supplied to the hydraulic pressure supply passage 115 from the hydraulic pressure supply pump 122 and the hydraulic pressure discharged from the hydraulic pressure discharge passage 116 and recovered by the hydraulic recovery pump 124 are outside the preset value.

Through this operation, the hydraulic pressure supplied to the hydraulic pressure supply passage 115 and the hydraulic pressure discharged from the hydraulic pressure discharge passage 116 may be maintained at a uniform pressure, and thus fastening force of the lockbolt for fastening the object through an operation of the lockbolt gun 110 may always be maintained.

The controller 150 may perform control to block air supply to the air supply passage 117 from the first sol valve 132 based on the operation signal of the operation switch 114*a* and to discharge the remaining air present on the air supply passage 117 through an air discharge port (not shown) included in the second sol valve 137.

Through this operation, even if an operator operates the operation switch 114*a* and then restarts the operation switch 114*a*, it may be possible to control an operation time of the lockbolt gun 110 in such a way that the lockbolt gun 110 is not operated for a predetermined time, and thus the operator may continuously operate the operation switch 114*a*, thereby preventing poor fastening in which the lockbolt is not fastened with specified fastening force.

The controller 150 may continuously control the air pressure regulator 136 according to a preset algorithm in order to correct the hydraulic pressure detected by the first hydraulic pressure sensor 115*a* to a preset value in conjunction with the temperature detected by the temperature sensor 142.

That is, the fastening force of the lockbolt for fastening the object needs to be maintained through an operation of the lockbolt gun 110 by correcting a change in hydraulic pressure supplied from the hydraulic pressure supply pump 122 to the hydraulic pressure supply passage 115 due to a change in the viscosity of oil stored in the oil tank 126 depending on temperature change according to seasonal change and daily temperature range.

As seen from the disclosed technology, it will be understood by those skilled in the art that it is possible to correct a change in hydraulic pressure due to a change in the viscosity of oil corresponding to temperature change according to seasonal change and daily temperature range based on a preset algorithm.

The controller 150 may perform control to operate the third sol valve 138 and to supply air supplied from the air supply unit 134 only when the lockbolt gun 110 is located in a pre-input working position, thereby preventing the operator from incorrectly fastening the lockbolt to a position other than the working position.

In this case, although not shown, as a method of recognizing the position of the lockbolt gun 110 by the controller 150, the lockbolt gun may be combined with a support installed to move in X-axis and Y-axis directions of a jig frame above the jig frame on which the object is accommodated and then the position of the lockbolt gun 110 may be determined by comparing the X-axis and Y-axis movement displacements of the support with a pre-input working position.

The first sol valve 132, the second sol valve 137, and the third sol valve 138 according to an embodiment of the present disclosure may have a valve having a physical spring device (not shown) and a bypass flow path (not shown) therein. This may enable an operation of the lockbolt by bypassing the pneumatic pressure supplied to the first sol valve 132, the second sol valve 137, and the third sol valve 138 even if the controller 150 fails.

Although the embodiments of the present disclosure have been described above with reference to the accompanying drawings, those skilled in the art may variously modify and change the present disclosure within the scope without departing from the technical spirit of the present disclosure described in the claims below.

INDUSTRIAL AVAILABILITY

The present disclosure may be used for a lockbolt fastening device for detecting an abnormal operation when objects are interconnected using a lockbolt.

The invention claimed is:

1. A lockbolt fastening device comprising:

a lockbolt gun including a body portion provided with a grip for pulling a lockbolt therein, and a grip portion protruding from a lower portion of the body portion and having an operation switch installed on an outside of the grip portion, wherein a hydraulic pressure supply passage configured to supply hydraulic pressure for driving the grip, a hydraulic pressure discharge passage configured to discharge hydraulic pressure supplied to the grip, and an air supply passage configured to supply pneumatic pressure to the operation switch are installed inside the grip portion, and a discharge hole configured to discharge air of the air supply passage when the operation switch is operated is formed outside the grip portion;

a driving force supply unit including a hydraulic pressure supply pump configured to supply hydraulic pressure to the hydraulic pressure supply passage, a hydraulic recovery pump configured to recover hydraulic pressure discharged from the hydraulic pressure discharge passage, and an oil tank configured to supply oil to the hydraulic pressure supply pump and to recover oil from the hydraulic recovery pump;

an operation unit including a first sol valve connected to the hydraulic pressure supply pump, the hydraulic recovery pump, and the air supply passage, an air supply unit configured to supply air to the first sol valve, and an air pressure regulator installed between the first sol valve and the air supply unit and configured to adjust pneumatic pressure supplied to the first sol valve;

a housing configured to accommodate the driving force supply unit and the operation unit; and a controller configured to, upon receiving an operation signal from the operation switch, perform control to supply the pneumatic pressure from the first sol valve to the hydraulic pressure supply pump and the hydraulic recovery pump and to operate the hydraulic pressure supply pump and the hydraulic recovery pump.

2. The lockbolt fastening device of claim 1, further comprising:

an air pressure sensor configured to detect pneumatic pressure supplied from the air supply unit, wherein the controller controls the air pressure regulator to operate when the pneumatic pressure supplied from the air supply unit is outside a preset value.

3. The lockbolt fastening device of claim 1, further comprising:

a first hydraulic pressure sensor configured to detect hydraulic pressure supplied to the hydraulic pressure supply passage; and a second hydraulic pressure sensor configured to detect hydraulic pressure discharged from the hydraulic pressure discharge passage, wherein the controller performs control to operate the air pressure regulator when the supplied hydraulic pressure and the discharged hydraulic pressure are outside a preset value.

4. The lockbolt fastening device of claim 1, wherein:

a second sol valve is installed between the first sol valve and the air supply passage; and the controller performs control to block air supply to the air supply passage from the first sol valve based on the operation signal of the operation switch and to discharge air present on the air supply passage through an air discharge port included in the second sol valve.

5. The lockbolt fastening device of claim 1, wherein:

a third sol valve is installed between the first sol valve and the air supply unit; and the controller performs control to operate the third sol valve and to supply the air to the first sol valve when the lockbolt gun is located in a pre-input working position.

6. The lockbolt fastening device of claim 3, further comprising:

a temperature sensor configured to detect temperature inside the housing, wherein the controller continuously controls the air pressure regulator according to a preset algorithm to correct the hydraulic pressure detected by the first hydraulic pressure sensor to a preset value in conjunction with the temperature detected by the temperature sensor.

* * * * *